United States Patent [19]

Duruz et al.

[11] 4,397,729

[45] Aug. 9, 1983

[54] CERMET ANODE ELECTROWINING METALS FROM FUSED SALTS

[75] Inventors: Jean-Jacques R. Duruz; Jean-Pierre Derivaz, both of Geneva, Switzerland

[73] Assignee: Diamond Shamrock Corporation, Dallas, Tex.

[21] Appl. No.: 319,091

[22] PCT Filed: Jan. 16, 1981

[86] PCT No.: PCT/US81/00064

§ 371 Date: Sep. 3, 1981

§ 102(e) Date: Sep. 3, 1981

[87] PCT Pub. No.: WO81/02027

PCT Pub. Date: Jul. 23, 1981

[30] Foreign Application Priority Data

Jan. 17, 1980 [GB] United Kingdom ..... 8001550

[51] Int. Cl.[3] ..... C25C 3/12; C25C 3/00

[52] U.S. Cl. ..... 204/243 R; 204/293

[58] Field of Search ..... 204/291, 292, 293, 243 R, 204/244–247, 67

[56] References Cited

U.S. PATENT DOCUMENTS

| | | | |
|---|---|---|---|
| 3,960,678 | 6/1976 | Alder | 204/291 X |
| 4,173,518 | 11/1979 | Yamada et al. | 204/291 X |
| 4,187,155 | 2/1980 | de Nora et al. | 204/291 X |

*Primary Examiner*—Donald R. Valentine

*Attorney, Agent, or Firm*—Bruce E. Harang

[57] ABSTRACT

An anode for use in electrowinning molten metal from a fused salt bath, e.g., aluminium from cryolite-alumina, consists of a cermet material formed from a ceramic oxide of, e.g., a ferrite or chromite, and a metal, e.g., a noble metal or alloy th

4 Claims, No Drawings

CERMET ANODE ELECTROWINING METALS FROM FUSED SALTS

BACKGROUND OF THE INVENTION

The invention relates to electrolytic cells for electrowinning metals from fused salt baths, especially aluminium from a fused cryolite-alumina bath. In the conventional Hall-Heroult process for aluminium electrowinning, consumption of the carbon anodes entails significant costs. The possibility of using metal oxides as anodes instead of consumable carbon anodes was investigated by A. I. Belyaev more than forty years ago (see, e.g., Chem. Abstr. 31, 1937, 8384 and 32, 1938, 6553). The state of the art relating to metal oxide anodes proposed for aluminium electrowinning may be illustrated for example by U.S. Pat. Nos. 4,039,401, 4,057,480, 4,098,669, 4,146,438, 3,718,550.

The use of inconsumable anodes for aluminium electrowinning would eliminate the significant costs of carbon replacement required for the carbon anodes currently used, as well as emissions from the cell, while allowing closer control of the anode-cathode gap. On the other hand, the oxygen evolution potential on an inconsumable anode would be higher than for the evolution of $CO_2$ on the carbon anode. The electrical energy consumption for aluminium production would thus be increased accordingly, unless other modifications are made in the design and mode of operation of the electrolytic cell.

The development of inconsumable anodes for aluminium electrowinning from fused cryolite-alumina is particularly difficult due to the fact that they must meet extremely strict requirements with regard to stability and conductivity under severe operating conditions. Such anodes must firstly be substantially insoluble and able to resist attack by both the cryolite-alumina bath at high temperature (about 1000° C.) and anodically generated oxygen. This first requirement is essential since contamination of the molten aluminium recovered at the cathode above the tolerated impurity levels would be undesirable.

In addition, inconsumable anodes having a higher electrical resistivity than the cryolite-alumina bath (about 0.3 ohm.cm) would have an uneven current distribution, whereby the anode current density may increase considerably towards the surface of the bath. Further, uneven distribution of the current density along the anode is also undesirable since it may contribute to corrosion of the anode near the phase boundary between the molten salt bath and the surrounding atmosphere (see e.g. U.S. Pat. No. 4,057,480).

Thus, for the reasons already mentioned, the electronic conductivity of the anode should be greater than 4 $ohm^{-1} cm^{-1}$ at 1000° C. Pure non noble metals have high conductivity but are unstable as anodes in fused cryolite-alumina. On the other hand the use of noble metals having adequate stability is restricted by their high cost. Further, the metal oxides which have been proposed as anode materials generally have inadequate electronic conductivity.

SUMMARY OF THE INVENTION

Thus, an object of the invention is to provide an anode material which is substantially resistant to attack by cryolite-alumina melts and anodically generated oxygen, has a high electronic conductivity, and can meet the technical and economic requirements of anodes for electrowinning aluminium from cryolite-alumina melts.

A more particular object of the invention is to provide such an anode material in the form of a cermet wherein a small amount of noble metal is incorporated in a ceramic phase so as to provide adequate conductivity in an economical manner.

DETAILED DESCRIPTION

The invention provides cermet anodes which are suitable for electrowinning metals from fused salt baths, especially aluminium from fused cryolite-alumina and are composed of a ceramic phase and a metallic phase which are respectively selected from a limited number of oxides and metals.

The ceramic phase of the cermet according to the invention is selected from the group of oxides consisting of nickel, copper and zinc; ferrites or chromites of iron, nickel, copper and zinc; ferric oxide; chromic oxide; nickel oxide; cupric oxide; and zinc oxide.

The metallic phase of the cermet according to the invention is selected from the group consisting of palladium, platinum, iridium, rhodium, gold, and alloys thereof. Such alloys may consist of noble metals of this group in suitable combinations with each other, or with iron, cobalt, nickel or copper whereby to reduce the cost of the metallic phase.

Ceramics selected from said group of oxides according to the invention have been found to have relatively high stability under the severe anodic conditions of aluminium electrowinning from cryolite-alumina melts, whereas their electrical conductivity is inadequate. It has also been found that when these ceramics are properly combined with metals according to the invention, a cermet can be obtained which has satisfactory stability and conductivity under said anodic conditions. The oxide of the ceramic phase is thermodynamically more stable than oxides which may be formed by the metallic phase, so that reduction of the ceramic phase by the metallic phase is avoided in the cermet according to the invention.

It has moreover been found that the density of a cermet material according to the invention should be increased as far as possible towards 100% of the theoretical density, in order to provide maximum resistance to attack under anodic conditions in a cryolite-alumina melt; namely at least 90%, and preferably greater than 95%.

The cermet material of the anode according to the invention should contain a uniformly distributed metallic phase in an amount sufficient to provide the cermet with an electronic conductivity greater than 4 $ohm^{-1} cm^{-1}$ at 1000° C. The electronic conductivity of the cermets according to the invention may preferably be greater than 20 $ohm^{-1} cm^{-1}$ at 1000° C. so as to correspond to the conductivity of the metallic phase forming a continuous network throughout the cermet material. However, the proportion of the noble metal or noble metal alloy phase incorporated in the cermet should generally be limited so as to decrease the cost of the cermet as far as possible while ensuring adequate conductivity and stability. The amount of the metallic phase incorporated in the cermet may lie between 2% and about 30% by volume of the cermet, preferably between 5 and 15 vol. %.

An experimental program was carried out within the framework of the invention with a view to finding suitable anode materials. This program included the investigation of on one hand a broad range of base metals comprising chromium, iron, cobalt, nickel, copper, tungsten, molybdenum, and on the other hand noble metals comprising rhodium, palladium, iridium, platinum, gold. These metals were investigated in the form of metallic anodes by means of cyclic voltametry, and by galvanostatic anodic polarisation in a cryolite-5% alumina melt at 1000° C.

From these investigations, it was established on one hand that said base metals underwent anodic corrosion at potentials below the oxygen evolution potential. It was further found that iron, cobalt, nickel and copper nevertheless exhibit a significantly better corrosion resistance than the other base metals investigated. It was also established that said noble metals are on the other hand substantially stable when used as an oxygen-evolving anode in a cryolite-5% alumina melt at 1000° C. Although these investigations showed that said noble metals provided suitable anode materials for electrolysis in cryolite-alumina melts, their exceedingly high cost could make anodes consisting solely of these noble metals quite prohibitive. The amount of said noble metals which may be incorporated in anodes must thus be reduced as far as possible for economic reasons, the economic use of noble metal in a cermet anode material being a particular object of the invention, as previously indicated.

Among the noble metals which may be used to form the metallic phase of the cermet anode material according to the invention, palladium is particularly advantageous due to its high stability, low density, and relatively low cost. Thus, since the electronic conductivity provided by the metallic phase depends essentially on its volume in the cermet, palladium may be used in smaller amounts to provide a continuous metallic phase, and that at a lower cost than with other noble metals.

It is understood that an anode for aluminium electrowinning may consist either entirely or partly of a cermet material according to the invention. For example, an electrode support body of any suitable shape and material may be covered with said cermet material.

The use of cermets as anode materials according to the invention provides a particular combination of advantages, namely:

Adequate chemical stability and electronic conductivity may be achieved in an economical manner by proper selection of combinations of the ceramic and metallic phases of the cermet from a restricted number of oxides and metals.

Improved mechanical properties and resistance to thermal shock due to combination of the metallic phase with the ceramic oxide phase.

Economy of costly metals incorporated in relatively small amounts in the cermet.

Said experimental program carried out within the framework of the invention also covered a broad range of refractory ceramic materials which seemed of potential interest as anodes to be used for aluminium electrowinning from cryolite-alumina melts. In one phase of this program, ceramic samples intended for preliminary corrosion resistance tests were prepared by isostatic cold-pressing of powders of about 40μ particle size, followed by sintering at temperatures lying in the range between 1300° C. and 1600° C. in air, or in argon when oxidizable components were contained in the samples. These corrosion-resistance tests consisted in immersing each ceramic sample for 2 hours in a cryolite-5% alumina melt at 1000° C. and measuring the resulting weight loss of the sample. $SnO_2$ based materials were found to lead to unacceptable tin contamination of the electrowon aluminium.

The invention further provides an electrolytic cell for electrowinning aluminium from a fused cryolite-alumina bath. This cell comprises at least one anode consisting essentially of a cermet material according to the invention, as set fourth in the claims. Said cell may further advantageously comprise a substantially inert solid cathode structure disposed at a predetermined distance below said anode, so as to thereby obviate the drawbacks of the conventional liquid metal cathode pool.

The following examples serve to illustrate the invention. Electrolytic tests relating to these examples were carried out with an apparatus for simulating aluminium electrowinning from a cryolite-alumina metal, comprising:

An electrolysis crucible of dense alumina (60 mm diameter × 100 mm).

A small alumina crucible for containing aluminium (20 mm diameter × 20 mm).

A cathode current feeder rod of tungsten, shielded by a dense alumina tube, extending to the bottom of said small crucible.

The described cell assembly was enclosed in a container made of Inconel 600 TM and heated in a verticle electrical resistance furnace. Before each test, some pure aluminium (about 5 g of Merck pro analysi Al) was placed on the bottom of said small crucible and electrically contacted with the cathode feeder rod. The electrolysis crucible was heated to form an electrolysis melt. A cermet anode sample (5 × 5 × 30 mm) suspended from a platinum wire was partly immersed in the melt having reached thermal equilibrium at 1000° C. Each test run was carried out at a given constant electrolysis current for a given period, as indicated in the examples.

EXAMPLE I

Anode samples consisting of a cermet of nickel ferrite and palladium (Ref. 79/18/1, Table 1) were fabricated by hot-pressing and electrolytically tested as anodes in a laboratory experiment simulating the conditions of aluminium electrowinning from molten cryolite-alumina at 1000° C.

The cermet material (79/18/1) was fabricated by mixing powdered NiO and $Fe_2O_3$ with 20 vol.% Pd and sintering the resulting powder mixture (325 mesh, about 40μ) by hot-pressing at 1300° C. under a pressure of 500 kg/cm$^2$ for 15 minutes under argon.

The phases of this cermet material (79/18/1) were identified by X-ray diffraction and are given in Table 1. The resulting cermet material had a density corresponding to 91.3% of the theoretical density of the nickel ferrite/palladium cermet. Its electrical conductivity was 75 ohm$^{-1}$ cm$^{-1}$, measured at room temperature.

Electrolytic tests were carried out at constant current on anode samples of this cermet material in molten cryolite at 1000° C. containing 10% alumina by weight. These anode samples had the dimensions: 5 × 5 × 30 mm and were immersed to a depth of about 10 mm in the cryolite-alumina bath. The cathode was an aluminium pool of about 5 cm$^2$ surface area.

Table 1 shows the test conditions (anode/cathode current densities) and results for electrolytic test runs 187 and 206 which were carried out on these anode samples 79/18/1, for 6 and 18 hours, respectively. The cell voltage remained at about 3.5 V throughout these test runs, while the aluminium current efficiency was 55% and 81%, respectively. Table 1 also indicates the level of impurities found in the aluminium pool, said levels being corrected for an assumed aluminium current efficiency of 90%, which can be achieved industrially. The aluminum produced in Run 187 was analyzed by a method having a detection level of 90 ppm Pd and no palladium was detected. A more precise method of analysis used for Run 206 allowed the detection of 20 ppm Pd.

tested in the manner described in Example I. The relative density of sample 79/31/1 was 95%, and Table 1 shows the data of electrolytic test run 247/6.

EXAMPLE VI

Anode sample 79/32/1 of a cermet composed substantially of nickel ferrite and 10 vol. % palladium was fabricated and tested as described in Example I. The relative density of this cermet was 93% and its conductivity at room temperature was 80 $ohm^{-1} cm^{-1}$. Table 1 also shows the data of test run 241 carried out on anode sample 79/32/1.

TABLE 1

| Ref. Run | CERMET Phases Ceramic | Metal | Density % | ELECTROLYTIC TEST Current Density mA. $cm^{-2}$ Anode | Cathode | Cell Voltage V | Curr. Eff. % | Aluminium analysis wt % Fe | Ni | Pd |
|---|---|---|---|---|---|---|---|---|---|---|
| Ex. I | | | | | | | | | | |
| 79/18/1 | $NiFe_2O_4$ | Pd | 91.3 | | | | | | | |
| 187/6h | | | | 800 | 360 | 3.5–3.9 | 55 | 0.28 | 0.03 | — |
| 206/18h | | | | 680 | 360 | 3.5 | 81 | 0.30 | 0.09 | 0.002 |
| Ex. II | | | | | | | | | | |
| 79/18/2 | $NiFe_2O_4$ | Pd | 97 | | | | | | | |
| 264/40h | | | | 850 | 360 | 3.4 | 64 | 0.32 | 0.02 | 0.01 |
| Ex. III | | | | | | | | | | |
| 79/29/1 | $FeO_3$ | Pd | 97 | | | | | | | |
| 259/7h | | | | 950 | 360 | 3.9 | 76 | 0.41 | — | 0.002 |
| Ex. IV | | | | | | | | | | |
| 79/29/2 | $Fe_2O_3$ | Pd | 88 | | | | | | | |
| 321/6h | | | | 900 | 360 | 3.5–3.7 | 77 | 0.50 | — | — |
| Ex. V | | | | | | | | | | |
| 79/31/1 | $NiFe_2O_4$ | Pd | 95 | | | | | | | |
| 147/6h | | | | 1000 | 360 | 4.0–4.9 | 77 | 0.3 | 0.2 | 0.002 |
| Ex. VI | | | | | | | | | | |
| 79/32/1 | $NiFe_2O_4$ | Pd | 93 | | | | | | | |
| 241/6h | | | | 750 | 360 | 3.9–5.0 | 85 | 0.4 | 0.09 | — |

EXAMPLE II

Anode samples (Ref. 79/18/2) consisting of a cermet of nickel ferrite and palladium were fabricated and tested in the manner generally described in Example I. In this case, hot-pressing was performed at 1300° C. and 1000 $kg/cm^2$ for 30 minutes, in argon.

Sample 79/18/2 of the resulting cermet had a density of 97% and a conductivity of 90 $ohm^{-1} cm^{-1}$ at room temperature. An electrolytic test was carried out on this sample and the corresponding current densities, cell voltages, aluminium current efficiencies and level of impurities in the aluminium pool are indicated in Table 1.

EXAMPLE III

Anode sample (Ref. 79/29/1) consisting of a cermet of hematite and 20 vol. % palladium was fabricated and tested in the manner described in Example II, the corresponding electrolytic test data of Run 259/7 h being indicated in Table 1.

EXAMPLE IV

Anode sample (Ref. 79/29/2) consisting of a cermet of hematite and 20 vol. % palladium was fabricated by cold-pressing a powder mixture of $Fe_2O_3$ with 20 vol. % Pd at 1000 $kg/cm^2$ and then sintering at 1400° C. for 6 hours in air. It had a density of 88% and a conductivity of 70 $ohm^{-1} cm^{-1}$ at room temperature. Electrolytic test data for Run 321/6 is given in Table 1, as in the preceding examples.

EXAMPLE V

Anode sample 79/31/1 of a cermet composed of nickel ferrite and 15% palladium was fabricated and It should be noted that the described results may be improved by modifying the composition and manufacture of the cermets according to the invention with respect to the above examples. Thus, for example, the stability of the cermet may be considerably improved by increasing its density as far as possible up to 100% of theoretical. This might be achieved by optimizing the manufacturing conditions (temperature, pressure, duration), or by using a different method of manufacturing the cermet. Moreover, optimization of the relative proportions of the ceramic oxide and the metallic phases of the cermet may allow its noble metal content to be reduced while providing satisfactory conductivity. Other oxide-metal combinations than those described in the examples may likewise improve results.

It should moreover be noted that the aluminium contamination levels given in Table 1 with reference to the above examples may be significantly higher than may be expected in industrial operation. The reason for this is that the impurities detected in the laboratory experiments may at least partly originate from the cryolite bath itself, from the aluminium initially present, or from the cell assembly (outer container and heat shields made of Inconel ®). As a matter of fact, that this seems to be the case is indicated by further control test runs wherein electrolysis was carried out under similar operating conditions with the same cell assembly equipped with a pure carbon anode (instead of a cermet anode) and also resulted in nonnegligible contamination of the aluminium produced.

We claim:

1. An anode for electrowinning molten metal from a fused salt in an electrolytic cell comprising at least one anode immersed in a fused salt bath above a cathode disposed at the base of the cell, characterized in that the anode consists essentially of a cermet material composed of a ceramic phase formed of at least one oxide selected from the group consisting of nickel, ferrite and hematite; said ceramic phase being uniformly mixed with a metallic phase formed of at least one metal selected from the group consisting of palladium, platinum, iridium, rhodium, gold and alloys of these metals among themselves or with iron, cobalt, nickel or copper.

2. The anode of claim 1, characterized in that said metallic phase comprises palladium or a palladium alloy.

3. An electrolytic cell for electrowinning aluminum from a fused cryolite-aluminum bath, comprising at least one anode immersed in said bath above a cathode disposed at the base of the cell, characterized in that said anode consists essentially of a cermet material composed of a ceramic phase formed of at least one oxide selected from the group consisting of nickel ferrite or hematite; said ceramic phase being uniformly mixed with a metallic phase formed of at least one metal selected from the group consisting of palladium, platinum, iridium, rhodium, gold and alloys of these metals among themselves or with iron, cobalt, nickel or copper.

4. The electrolytic cell of claim 3, characterized in that said metallic phase comprises palladium or a palladium alloy.

* * * * *